US005079799A

United States Patent [19]

Rude et al.

[11] Patent Number: 5,079,799

[45] Date of Patent: Jan. 14, 1992

[54] FRICTION HINGE ASSEMBLY

[75] Inventors: Edward T. Rude, Columbia, Md.; Martin Waine, Riverside, Conn.

[73] Assignee: General Clutch Corporation, Stamford, Conn.

[21] Appl. No.: 613,025

[22] Filed: Nov. 14, 1990

[51] Int. Cl.[5] ..... E05C 17/64; E05D 11/08

[52] U.S. Cl. ..... 16/342; 16/322

[58] Field of Search ..... 16/342, 322, 316

[56] References Cited

U.S. PATENT DOCUMENTS 2,591,246 4/1952 Everest et al. .
2,598,985 6/1952 Everest et al. .
2,703,254 3/1955 Shockey ..... 16/342
2,816,332 12/1957 Domino .
3,474,487 10/1969 Resag et al. .
4,571,456 2/1986 Paulsen et al. .
4,697,630 10/1987 Rude .
4,781,422 11/1988 Kimble .

FOREIGN PATENT DOCUMENTS 342538 2/1931 United Kingdom ..... 16/342

*Primary Examiner*—Robert L. Spruill
*Assistant Examiner*—Carmine Cuda
*Attorney, Agent, or Firm*—Gottlieb, Rackman & Reisman

[57] ABSTRACT

There is disclosed a hinge assembly that has a pintle and two plates that can rotate about the axis of the pintle. The first plate is irrotatably affixed to the pintle. The second plate is part of a friction element which also includes a band having a plurality of turns helically disposed about the pintle. Between the other end of the band and the second plate there is a spring that tightens the band about the pintle. The band is flexible enough so that it does not grip the pintle without the force of the spring. Frictional force is developed between the band and the pintle that opposes movement of the second plate in a direction that tends to tighten the band about the pintle. Movement of the second plate in the opposite direction tends to loosen the band's grip on the pintle so that very little frictional force is developed.

18 Claims, 3 Drawing Sheets

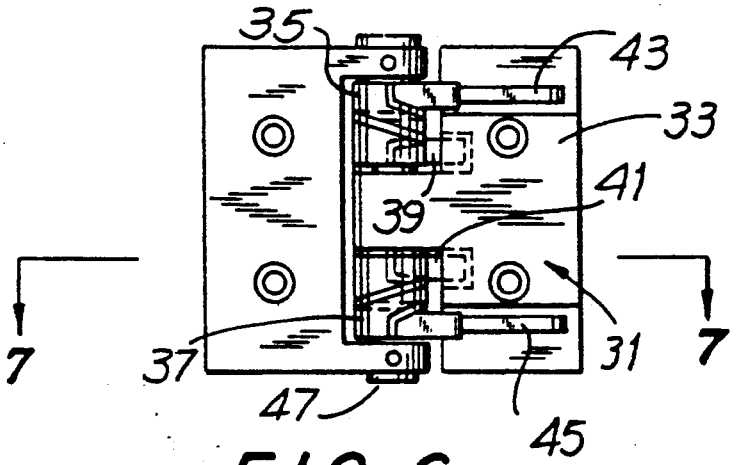
FIG. 6
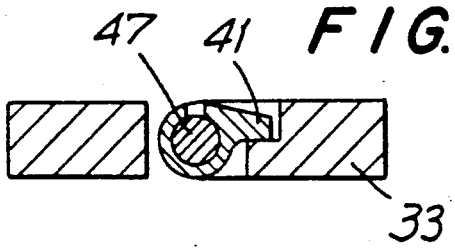
FIG. 7
FIG. 8
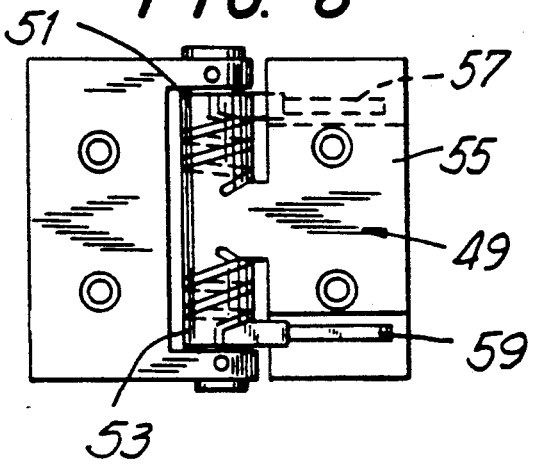
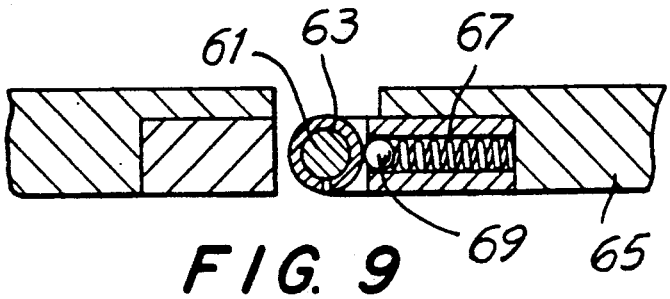
FIG. 9

FRICTION HINGE ASSEMBLY

Our invention relates to a hinge assembly in which friction is a benefit. Low friction is normally a desirable characteristic of hinges, and accordingly, they are usually manufactured to have the smallest possible amount of frictional torque. However, there are some applications for which it is desirable that a hinge have a certain amount of resistance to movement. U.S. Pat. No. 2,591,246 shows an adjustable footrest made with a friction hinge, and U.S. Pat. No. 4,781,422 shows a friction hinge used to maintain the angular position of the screen of a small portable computer. Screens on portable computers and cabinet doors are only two of many applications for which it may be desirable to rotatably position a hinge mounted part.

Our invention uses a helical band which tightens about a pintle to provide a hinge with friction so that a particular torque is required to change its angular opening, that is, to rotate one element or side of the hinge with respect to the other.

A shortcoming of many prior art devices that use friction for positioning is their inability to maintain a constant frictional torque from unit to unit, and also over time within an individual unit as it wears. Our invention provides the means of keeping the torque constant without the need for sensitive adjustments during manufacture. Our invention also provides a hinge whose frictional characteristic do not change with wear and changing environmental conditions. Another shortcoming of the prior art devices is excessive lost motion. Practical manufacturing requires clearances between parts that result in lost motion. Our device uses inexpensive molded components in an innovative manner that avoids lost motion. Prior art frictional devices do not provide a means for achieving different values of torque for different directions of rotation. Our invention provides for different torques for each direction.

Accordingly, it is the object of the invention to provide an improved friction hinge.

It is an object of our invention to provide a means for mounting and rotatably positioning computer screens or other objects.

It is also an object of our invention to provide a hinge assembly with the friction needed to maintain the angular opening of a hinge.

It is a further object of our invention to provide a hinge assembly having controllable friction in a hinge without lost motion when changing directions.

It is a still further object of our invention to provide a hinge assembly having a different frictional torque for each direction of rotation.

It is a still further object of our invention to provide a friction hinge assembly having a low manufacturing cost.

It is a still further object of our invention to provide a hinge assembly in which the torque is insensitive to manufacturing tolerances.

It is yet a further object of our invention to provide a friction hinge assembly having a very small size.

It is a still further object of our invention to provide a friction hinge assembly having low wear by having a large contact area between friction elements.

It is a still further object of our invention to provide a friction hinge assembly whose torque does not vary due to wear.

Still other objects and advantages of the invention spring clutch will in part be obvious and will in part be apparent from the following specification.

BRIEF DESCRIPTION OF THE INVENTION

Briefly, the hinge assembly of our invention is made in the familiar form of a hinge. The hinge assembly has a pintle and two plates that can rotate about the axis of the pintle. The first plate is irrotatably affixed to the pintle. The second plate is part of a friction element which also includes a band having a plurality of turns helically disposed about the pintle. Between the other end of the band and the second plate there is a spring that tightens the band about the pintle. The band is flexible enough so that it does not grip the pintle without the force of the spring. Frictional force is developed between the band and the pintle that opposes movement of the second plate in a direction that tends to tighten the band about the pintle. Movement of the second plate in the opposite direction tends to loosen the band's grip on the pintle so that very little frictional force is developed.

In order for the hinge assembly opening to change, the band must slip about the pintle. For one direction, the direction requiring the greater torque to produce movement, the torque that will cause the band to slip about the pintle is given by the relationship:

$$T = Me^{uA}$$

in which:

u = coefficient of friction between band and pintle,

A = angle of wrap-band about pintle, and

M = moment applied at the trailing end of the band.

This moment M, is the tension in the tail of the band times the pintle radius. It can be produced by various methods. In the preferred embodiment, it is applied by the spring, and is equal to the spring force times the perpendicular distance between the spring and pintle axes. In the other direction, the frictional torque cannot exceed M.

If the device is slipping then the appropriate coefficient of friction is the dynamic one between the pintle and the band materials. If there is no relative motion between the pintle and the band, then the maximum braking force that can be achieved without slipping will be obtained by using the static coefficient of friction in the above equation.

In the preferred embodiment of our invention, the band and one plate of the hinge assembly are made as a single, molded plastic part.

The inventive friction hinge assembly accordingly comprises the features of construction, combination of elements, and arrangement of parts which will be exemplified in the constructions described hereinafter, and the scope of the invention will be indicated in the claims.

BRIEF DESCRIPTION OF THE DRAWINGS

FIG. 6 is a top view of yet another embodiment of the hinge incorporating two bands, operationally similar to the hinge of FIG. 4, but different in construction, FIG. 7 is a cross-sectional view of the hinge of FIG. 6 taken along the line C—C, and FIG. 8 is a top view of yet another embodiment of the hinge incorporating two bands configured to produce torque in opposite directions.

FIG. 9 is a cross-sectional view of an alternative method for producing the necessary tension in the band using friction between the band and the pintle.

DETAILED DESCRIPTION OF THE DRAWINGS

Figure 1:
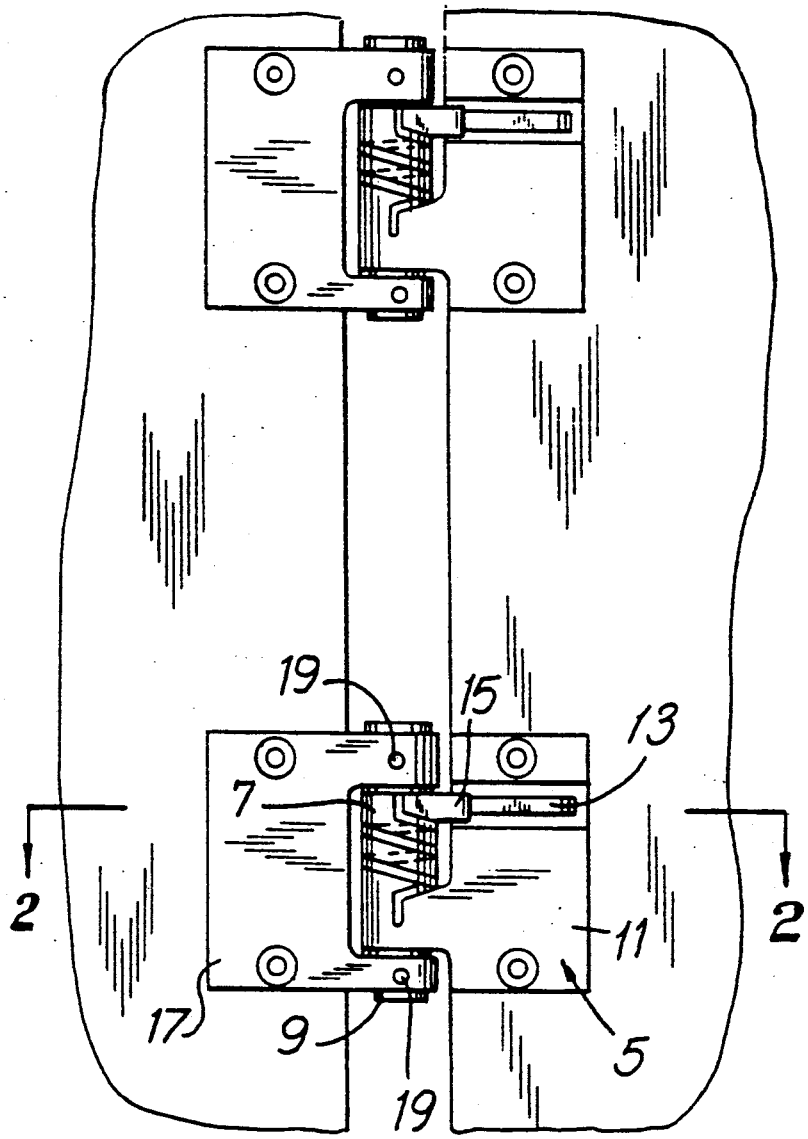
FIG. 1 shows cut-away segments of two elements that are held together with a pair of friction hinges that have high torque in one direction and low, residual torque in the other direction.
Figure 2:
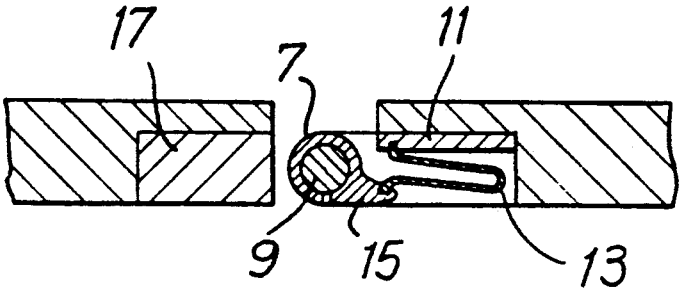
FIG. 2 is a cross-sectional view of the hinge of FIG. 1. taken through the spring and the tail end of the band.

FIG. 1. shows two elements, part 1 and part 3, connected by a pair of identical friction hinges of our invention. Two hinge assemblies are used to provide proper hinging action and to eliminate relative rotation of parts 1 and 3 about any axis other than the axis of the two assemblies. It should be noted that it would also be possible to use one friction hinge assembly with one conventional hinge. Hinge element 5, which is attached to part 3 with screws or rivets, or other appropriate means, has a spiral portion or band 7, comprised of several turns disposed about pintle 9, and a flat portion for attachment, plate member 11. Spring 13 keeps band 7 tightly wrapped about pintle 9 by applying a force between plate member 11 and tail 15 of band 7. On the other side of the hinge assembly, plate 17 is irrotatably attached to pintle 9 by pins or other appropriate means. Plate 17 is attached to part 1. FIG. 2 is a cross-sectional view of one of the hinge assemblies of FIG. 1 taken along the line A—A.

Assembly is accomplished by inserting pintle 9 through plate 17 and band 7 before the installation of spring 13. Pins 19 hold pintle 9 in plate 17 and prevent relative movement. As best seen in FIG. 2, spring 13 is held in place by the insertion of its bent ends into pockets provided in plate 11 and tail 15.

It will be obvious to those experienced in the art that spring 15, which is shown here as a hairpin spring, could as easily be a compression spring. Also, simply by altering the relative orientations of tail 15 and plate 11, the same effect could be obtained with a tension spring.

Hinge element 5 is preferably a plastic part, molded of a glass reinforced material. However, an acceptable alternative is to make it as an assembly, with a band portion and a plate member portion joined together. These could be of the same or of different material according to the properties desired and manufacturing techniques available.

Figure 3:
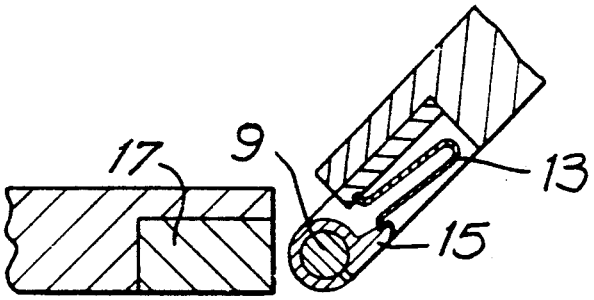
FIG. 3 is the same cross-sectional as FIG. 2 except that one side of the hinge has been rotated.

In operation, to rotate the hinge assembly from the position shown in FIG. 2 to the position shown in FIG. 3, the full frictional torque must be overcome. This direction of rotation is opposite to the direction of the moment applied by the spring. When moved in the opposite direction, plate member 11, as will be seen in FIG. 1, moves in a direction so as to loosen the grip of band 7 on pintle 9, while spring 13 maintains pressure on tail 15. Because there is now no restraining force applied at the trailing end of the band, only a very slight residual torque will be needed to produce movement. In fact, the required torque is equal to the moment about the pintle axis due to the spring.

The action of spring 13 to keep band 7 wrapped against pintle 9 at all times means that, when the direction of motion is reversed, there is no clearance or slack to be taken up before the frictional torque becomes effective. Therefore, the device exhibits no lost motion or backlash.

Using molded parts, it is a simple matter to make the hinge assembly of FIG. 1 with two bands. The two bands can be arranged to provide torque for the same rotational direction or for opposite directions. If they act in opposite directions, the torque provided by each of the bands can be the same or different according to the configuration of the bands and the springs. The torque can be varied, according to the equation given above, by varying the band's angle of wrap about the pintle, or by varying the applied moment M.

Figure 4:
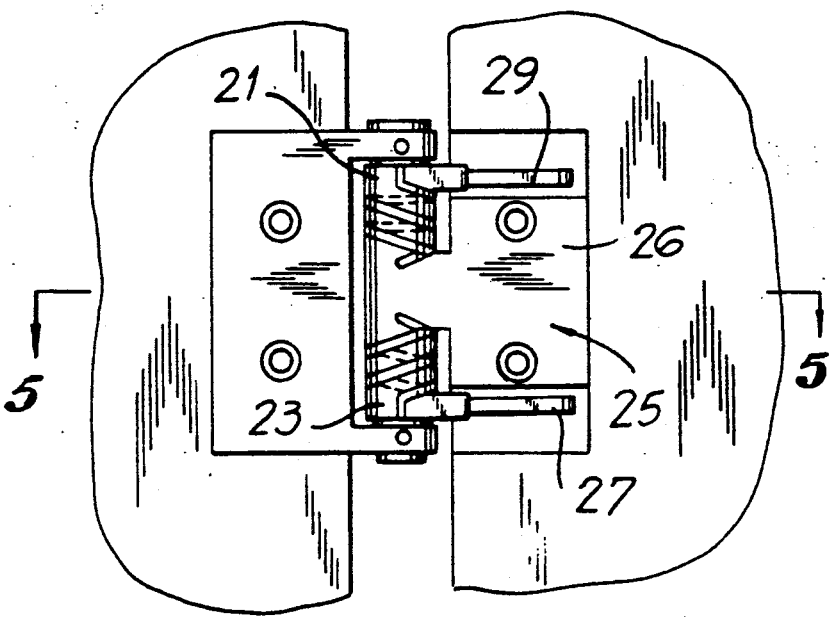
FIG. 4 is a top view of another embodiment of the hinge incorporating two bands for increased torque.

FIG. 4 shows a hinge assembly that is similar to the hinge of FIG. 1, but having two bands 21 and 23 and plate member 26, both molded as a part of the same hinge element 25. Both bands act to produce friction in the same direction. Separate springs, 27 and 29, tension the two tails. Like the hinge assembly of FIG. 1, this hinge assembly is configured to provide high torque in one direction, and low torque in the other direction.

Figure 5:
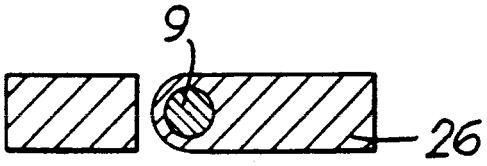
FIG. 5 is a cross-sectional view of the hinge of FIG. 4 taken along the line C—C.

FIG. 5 shows a cross section of the hinge assembly of FIG. 4 taken along the line B—B.

FIG. 6 shows a hinge assembly similar to the hinge of FIG. 4 except that, in this hinge assembly, hinge element 31 is comprised of separate parts, namely plate member 33 and bands 35 and 37. Bands 35 and 37 have lugs 39 and 41 respectively for contacting plate member 33. Springs 43 and 45 maintain band tension as before, but in this case, since the band and the plate member are not one piece, the springs also have the job of keeping lugs 39 and 41 in contact with plate member 33. Wheter the friction element is made in one piece or as an assembly of several parts is purely a matter of manufacturing preference. The device behaves the same way in either case. Referring to FIGS. 6, 2, and 7, when plate member 33 rotates in the counter clockwise direction, it increases the pressure against lugs 39 and 41, tightening bands 35 and 37 about pintle 47, thereby increasing the frictional torque. When plate member 33 rotates in the clockwise direction springs 43 and 45 rotate the bands to maintain contact between the lugs and plate member 33. Since contact is maintained between the lugs and the plate member as well as between the bands and the pintle at all times, there is still essentially no lost motion.

FIG. 8 depicts a hinge assembly similar to the hinge assembly of FIG. 4 except that the hinge of FIG. 8 provides the higher level of torque for both directions of rotation. In this embodiment of the invention, hinge element 49 has two bands 51 and 53. But, whereas in FIG. 4 the two bands were configured to produce torque in the same direction, in FIG. 8 the bands are configured to produce torque in opposite directions. Since the plate member is connected to the left end of one band and the right end of the other, this requires that the helices of the two bands have the same direction. As in the previously discussed embodiments, the two springs can be individually selected to produce the same or different torque values for each direction.

FIG. 9. depicts an alternate method for producing the required tension in the band. In this case, friction is produced between pintle 61 and band 63 by a pressure mechanism contained within plate 65. The pressure mechanism in this embodiment is comprised of a simple spring 67 forcing ball 69 radially inward against the end of band 63. When plate 65 is rotated about pintle 61, moving the other end of the band, the friction created by the ball against the band retards the trailing end of the band, tightening it about the pintle. This produces much the same effect that is produced in the previous embodiments by the spring. However, this embodiment has the disadvantage that there is backlash produced during any change in the direction of rotation because the friction retards the movement of the end of the band creating a certain looseness of the band about the pintle, whereas, in the other embodiments, the spring keeps the band tight about the pintle, eliminating all backlash.

It will thus be seen that the objects set forth above among those made apparent from the preceding description, are efficiently attained and, since certain changes may be made in the construction of the inventive spring clutch without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

We claim:

1. A hinge assembly comprising:

a first plate member rotatably connected to a pintle;

a first band helically and loosely wound about at least a portion of said pintle having a first end connected to said plate member and a second end;

wherein said second end of said first band is connected to said first plate member by a spring for tightening said first band about said pintle in a first rotating direction;

wherein said first plate member is pivotable about said pintle in said first rotating direction and in a second rotating direction opposite said first rotating direction.

2. The hinge assembly of claim 1, wherein said first end of the said first band is connected directly to said first plate member.

3. The hinge assembly of claim 2, wherein said first plate member is integrally formed with said helically wound band.

4. The hinge assembly of claim 1, wherein said first end of said first band is in substantially continuous contact with said first plate member by means of a lug.

5. The hinge assembly of claim 1, wherein said second end of said first band includes a tail upon which said spring applies a force for tightening said first band about said pintle in said first rotating direction.

6. The hinge assembly of claim 1, further including a second plate member irrotatably connected to said pintle.

7. The hinge assembly of claim 6, wherein said second plate member is connected to said pintle by at least one pin element.

8. The hinge assembly of claim 1, wherein said pintle has an upper portion and a lower portion and wherein said first band is helically wound about said upper portion.

9. The hinge assembly of claim 8, further including:

a second band helically wound about the lower portion of the pintle having a first end connected to said first plate member and a second end; and a second spring for connecting said second end of said second band to said first plate member.

10. The hinge assembly of claim 9, wherein said second end of said second band is connected to said first plate member by said second spring for tightening said second band about said pintle in said first rotating direction.

11. The hinge assembly of claim 10, wherein said first end of said second band is connected directly to said first plate member.

12. The hinge assembly of claim 11, wherein said first plate member is integrally formed with both said first helically wound band and said second helically wound band.

13. The hinge assembly of claim 10, wherein said first end of said first band is in substantially continuous contact with said first plate member by means of a first lug and wherein said first end of said second band is in substantially continuous contact with said first plate member by means of a second lug.

14. The hinge assembly of claim 9, wherein said second end of said second band is connected to said first plate member by said second spring for tightening said second band about said pintle in said second rotating direction opposite said first rotating direction.

15. The hinge assembly of claim 14, wherein said first spring applies a force to the second end of the first band having a first magnitude and said second spring applies a force to the second end of said second band having a second magnitude different than the first magnitude.

16. The hinge assembly of claim 14, wherein said first plate member is integrally formed with both said first helically wound band and said second helically wound band.

17. A hinge assembly comprising:

a plate member rotatably connected to a pintle;

a band helically and loosely wound about at least a portion of said pintle having a first end connected to said plate member and a second end;

means for urging the second end of the band radially inward; comprising a ball pressed against said second end of the band by the action of a spring.

18. A hinge assembly comprising:

a plate member rotatably connected to a pintle;

a band helically and loosely wound about at least a portion of said pintle having a first end connected to said plate member and a second end;

a resilient member connecting said second end of said band to said plate member for enabling tightening of the band about the pintle;

wherein said plate member is pivotal about said pintle in a first rotating direction and in a second rotating direction opposite said first rotating direction.

* * * * *